US006311842B1

(12) United States Patent
Minerich et al.

(10) Patent No.: US 6,311,842 B1
(45) Date of Patent: Nov. 6, 2001

(54) PACKAGING METHODS AND PRODUCTS

(75) Inventors: Phillip L. Minerich; Jeffrey E. Johnson, both of Austin, MN (US); Nicholas A. Philips, Sugar Grove, IL (US)

(73) Assignee: Hormel Foods, LLC, Austin, MN (US)

( * ) Notice: Subject to any disclaimer, the term of this patent is extended or adjusted under 35 U.S.C. 154(b) by 0 days.

(21) Appl. No.: 09/351,883

(22) Filed: Jul. 13, 1999

(51) Int. Cl.[7] ..... B65D 81/02

(52) U.S. Cl. ..... 206/562; 206/563; 206/589; 229/920; 229/931

(58) Field of Search ..... 206/151, 158, 206/199, 562, 563, 589, 446; 229/902–904, 904.1, 120.11, 120.17, 183, 185, 117.01, 920, 931; 493/56, 63, 73

(56) References Cited

U.S. PATENT DOCUMENTS

| | | | | |
|---|---|---|---|---|
| 2,330,345 | | 9/1943 | Elliot | 229/16 |
| 2,547,716 | * | 4/1951 | Murphy | 206/562 |
| 2,834,461 | | 5/1958 | Dusseault | 206/65 |
| 2,919,844 | | 1/1960 | Anderson, Jr. | 229/28 |
| 3,390,783 | * | 7/1968 | Quackenbush, Jr. | 206/562 |
| 3,407,986 | * | 10/1968 | Manizza | 206/562 |
| 3,840,171 | | 10/1974 | Waters | 229/28 R |
| 3,949,930 | | 4/1976 | Giordano | 229/28 R |
| 4,053,099 | | 10/1977 | Lock | 229/28 R |
| 4,156,484 | | 5/1979 | Wischusen | 206/563 |
| 4,194,678 | | 3/1980 | Jasper | 229/23 R |
| 4,328,922 | | 5/1982 | Hirata | 229/27 |
| 4,469,271 | | 9/1984 | Kulig | 229/28 R |
| 4,572,423 | * | 2/1986 | Spencer | 229/904 |
| 5,057,282 | * | 10/1991 | Linder | 206/562 |
| 5,197,606 | | 3/1993 | Lancaster | 206/594 |
| 5,205,474 | | 4/1993 | Stuart et al. | 229/1.5 H |
| 5,765,690 | | 6/1998 | Baxter | 206/562 |

* cited by examiner

*Primary Examiner*—Jim Foster
(74) *Attorney, Agent, or Firm*—Mau & Krull, P.A.

(57) ABSTRACT

At least one corrugated sheet is formed into a corrugated carton has a top panel, a bottom panel, opposite side walls, and opposite end walls. Intermittently spaced slits are formed through the corrugated sheet along fold lines defined between the top panel and the side walls and between the top panel and the end walls. Discrete openings are provided in the top panel to receive individual cans.

16 Claims, 2 Drawing Sheets

PACKAGING METHODS AND PRODUCTS

FIELD OF THE INVENTION

The present invention relates to packaging methods and products and more specifically, to the packaging of multiple cans within a single corrugated carton for bulk distribution.

BACKGROUND OF THE INVENTION

Consumer products are typically provided in relatively small containers which in turn, are often bulk packaged in relatively larger containers for distribution to consumers. For example, many food products have been stored in cans having a top, a bottom, and a circumferential sidewall. In many cases, the top and bottom components cooperate with the sidewall to define outwardly projecting rims. When these "three-piece" cans are placed adjacent one another in a corrugated box, the upper and lower rims abut one another, and the sidewalls remain spaced apart from one another. As a result, the rims not only contribute to the structural integrity of the individual cans, but also reduce the likelihood of damage to the cans during shipping and handling of the corrugated box containing the cans. With regard to the latter attribute, impact directed against the side of the box is transmitted through the relatively sturdy rims of the cans, as opposed to the less sturdy sidewalls.

Another type of food can has a bottom which is integrally and/or seamlessly joined to the sidewall, leaving a rim about the top of the can but no comparable structure at the bottom of the can. While this second, "two-piece" type of can is desirable in certain respects, it has been found to be more vulnerable to damage when bulk packaged in conventional fashion and subjected to shipping and handling. In other words, room for improvement remains with respect to the bulk packaging of two-piece cans inside corrugated boxes.

SUMMARY OF THE INVENTION

One aspect of the present invention is to package two-piece cans within a corrugated carton to facilitate shipping and handling of the cans in bulk quantities. The carton is formed with discrete openings in a top panel to receive the cans, and with intermittently spaced slits at junctures between the top panel and adjacent side walls of the carton. The resulting configuration is well suited to absorb impact, thereby reducing the likelihood of damage to the cans packaged therein. Many of the features and/or advantages of the present invention will become apparent from the more detailed description that follows.

BRIEF DESCRIPTION OF THE FIGURES OF THE DRAWINGS

With reference to the Figures of the Drawing, wherein like numerals represent like parts and assemblies throughout the several views.

DETAILED DESCRIPTION OF A PREFERRED EMBODIMENT

Figure 1:
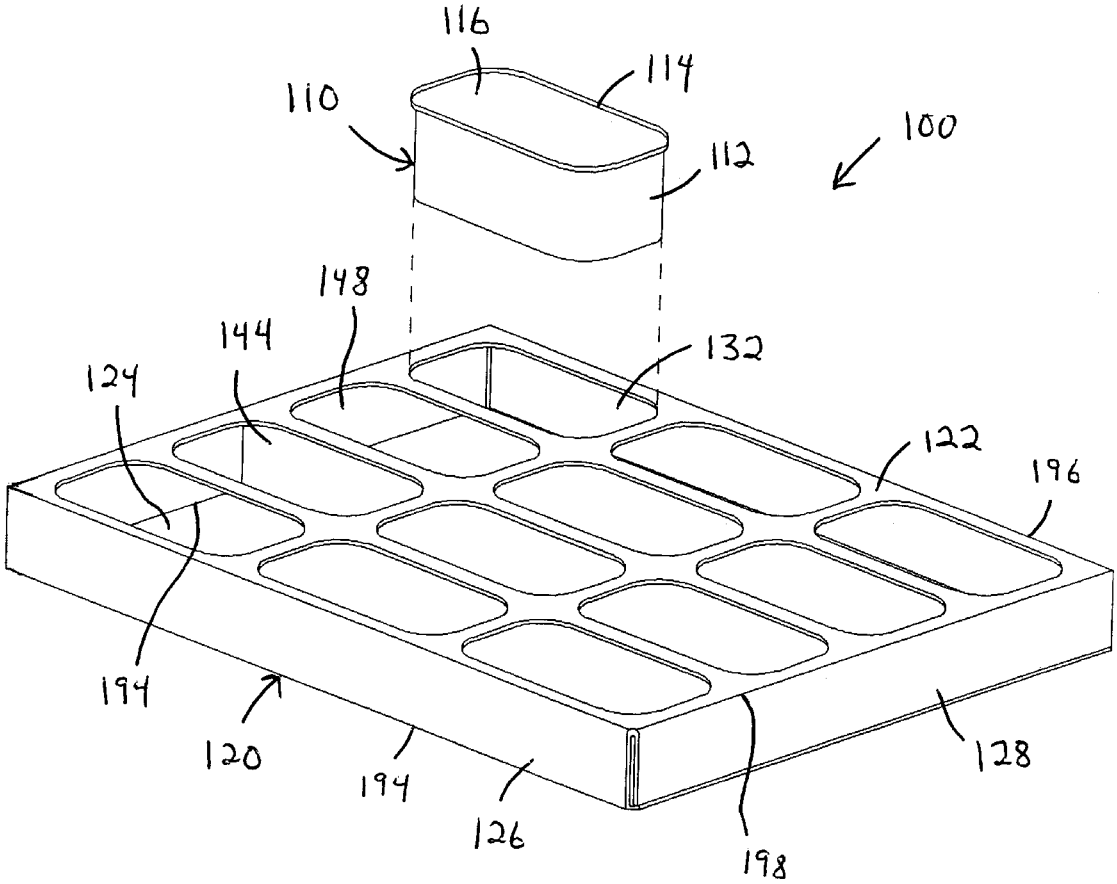
FIG. 1 is a perspective view of a packaging arrangement constructed according to the principles of the present invention.

The present invention may be described in terms of packaging methods and/or products. A preferred embodiment of the present invention is designated as 100 in FIG. 1, and may be described with reference to a can 110 and a carton 120. The can 110 is sometimes described in the industry as a "two-piece" can, having a top 116 and a cup-shaped body including a sidewall 112 and an integrally connected bottom. The top 116 and the sidewall 112 are interconnected in a manner which forms an outwardly projecting rim 114.

Figure 2:
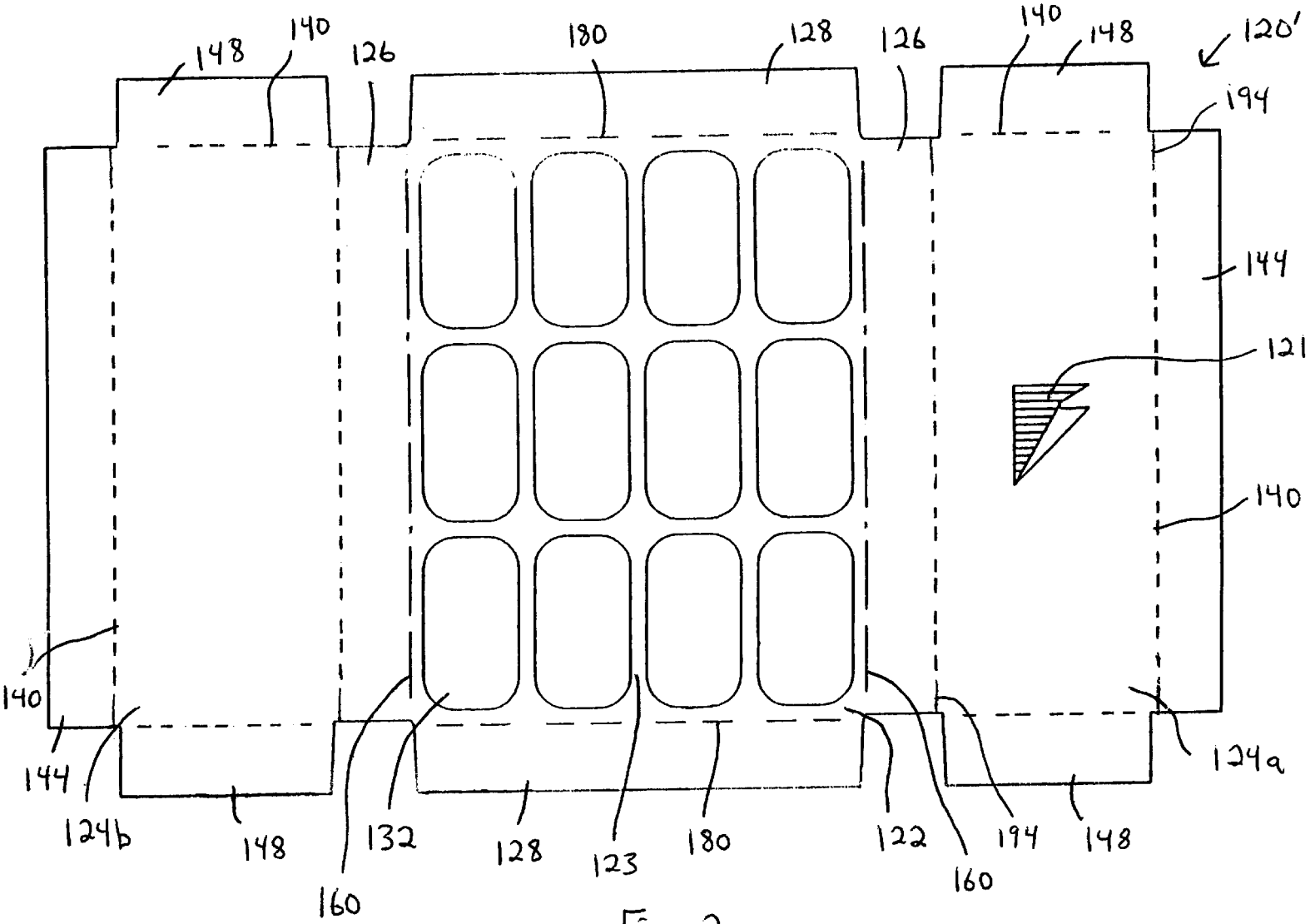
FIG. 2 is a planform view of a corrugated sheet which is formed according to the principles of the present invention, and which may be manipulated into the carton shown in FIG. 1.

The carton 120 is made from the corrugated sheet designated as 120' in FIG. 2. As is known in the art, the corrugated sheet 120' includes reinforcing ribs 121 which extend parallel to one another between two planar sheets. A corrugated blank is subjected to a die cutting process in order to arrive at the corrugated sheet 120' shown in FIG. 2.

The sheet 120' may be described with reference to a top panel portion 122, two bottom panel portions 124*a* and 124*b*, opposite side wall portions 126, and opposite end wall portions 128. The bottom panel portions 124*a* and 124*b* include flaps 144 and 148. Junctures or lines of separation extend between the discrete portions of the sheet 120', and both fold lines and slits are provided along these junctures. For purposes of illustration, the fold lines are designated by reference numerals 194, 196, and 198 in FIG. 1, and the slits are designated by reference numerals 140, 160, and 180 in FIG. 2. The fold lines 194 are also shown at the ends of the slits 140 in FIG. 2.

The top panel portion 122 has a rectangular perimeter bounded by the side wall portions 126 and the end wall portions 128. Openings 132 extend through the top panel portion 122 and define a two-dimensional array (which is 3×4 in the depicted embodiment 100). Each opening 132 has a width, which is measured parallel to the reinforcing ribs 121, and a relatively longer length, which is measured perpendicular to the ribs 121. Each opening is sized and configured to receive an intermediate cross-section of the sidewall 112 of the can 110. The size and relative positions of the openings 132 are such that the top panel portion 122 is configured in a manner similar to a lattice, which maintains the rims 114 of the cans 110 spaced apart from one another.

Slits 160 extend through the sheet 120' along the lines of separation between the top panel portion 122 and each of the side wall portions 126. The slits 160 are intermittently spaced, with two relatively longer, equal length slits spanning the majority of the length of each opening 132, and a relatively shorter slit centered between adjacent pairs of the longer slits.

Slits 180 extend through the sheet 120' along the lines of separation between the top panel portion 122 and each of the end wall portions 128. The slits 180 are intermittently spaced, with two equal length slits spanning the majority of the width of each opening 132.

The side wall portions 126 are integrally connected between respective sides of the top panel portion 122 and respective bottom panel portions 124*a* and 124*b*. Slits 140 extend through the sheet 120' along the lines of separation between the bottom panel portions 124*a* and 124*b* and respective adjoining portions. The equal length slits 140 are intermittently spaced and relatively shorter in length (particularly in comparison to the longer slits 160).

For purposes of describing the assembly of the carton 120, it is assumed that the inside surface of the sheet 120' is shown in FIG. 2. The sheet 120' is assembled into the carton 120 by (a) folding the end flaps 148 relative to respective bottom panel portions 124*a* and 124*b* so that the inside surfaces on the end flaps 148 face toward one another; (b)

folding the intermediate flaps 144 relative to respective bottom panel portions 124*a* and 124*b* so that the inside surfaces faces on the intermediate flaps 144 face toward one another; (c) folding the bottom panel portions 124*a* and 124*b* relative to respective side wall portions 126 so that the inside surfaces on the bottom panel portions 124*a* and 124*b* face toward one another; (d) folding the side wall portions 126 relative to the top panel portion 122 so that the inside surfaces on the side wall portions 126 face toward one another, and the outside surfaces on the intermediate flaps 144 come into contact with one another, and the flaps 144 underlie a central portion 123 of the top panel portion 122, and the bottom panel portions 124*a* and 124*b* cooperate to define a bottom panel 124; (e) depositing adhesive on the inside surfaces on the end wall portions 128 and/or on the outside surfaces on the end flaps 148; (f) folding the end wall portions 128 relative to the top panel 122 so that the inside surfaces on the end wall portions 128 come into contact with outside surfaces on respective end flaps 148. The end flaps 148 on the bottom panel 124 are configured and arranged to define intermediate gaps along each end wall portion 128, beneath the central portion 123, to receive and retain the distal ends of the intermediate flaps 144.

As suggested by the dashed lines in FIG. 1, a like can 110 is inserted into each of the openings 132 in the resulting carton 120. For shipping and handling purposes, the cans 110 may be encouraged to remain inside the carton 120 by shrink wrap or other suitable means.

Testing has indicated that the slits 160 and 180 in the carton 120 reduce the likelihood of damage to the cans 110 when the carton is subjected to laterally directed impact (as might be expected during forklift operation, for example). In this regard, the slits 160 and 180 facilitate flexing of the carton 120 in response to such an impact, and the isolated cans 110 tend to float as the carton 120 flexes. In this regard, the carton 120 may be described as an impact-absorbing package and/or as having an impact absorbing means integrated therein. Also, the intermediate flaps 144 form a double-walled I-beam for giving additional strength end to end.

The foregoing description and accompanying figures are limited to a preferred embodiment and a specific application of the present invention. However, those skilled in the art may recognize additional variations and/or modifications which incorporate the essence of the present invention. For example, other cartons may be constructed in accordance with the principles of the present invention to accommodate cans of different sizes and/or in different quantities. Accordingly, the scope of the present invention is to be limited only to the extent of the following claims.

What is claimed is:

1. A corrugated carton sized and configured to retain a plurality of otherwise loose cans, comprising:

at least one sheet of corrugated formed into a parallelepiped configuration having a top panel, a bottom panel, opposite end walls, having lateral edges and opposite side walls having lateral edges, wherein openings extend through the top panel to receive the cans, and intermittently spaced slits extend through the corrugated at otherwise integral junctures defined between the top panel and respective side walls to facilitate flexing of the carton in response to impact directed against the side walls and the lateral edges of the end walls are free from the lateral edges of the side walls to permit flexing along the slits in response to impact directed against the side walls.

2. The corrugated carton of claim 1, wherein intermittently spaced slits extend through the corrugated at otherwise integral junctures defined between the top panel and respective end walls.

3. The corrugated carton of claim 2, wherein each of the side walls is interconnected between the top panel and the bottom panel, and each of the side walls extends laterally between opposite distal edges.

4. The corrugated carton of claim 3, wherein each of the end walls is interconnected between the top panel and the bottom panel, and each of the end walls extends laterally between opposite distal edges.

5. The corrugated carton of claim 1, wherein each of the side walls is interconnected between the top panel and the bottom panel, and each of the side walls extends laterally between opposite distal edges.

6. The corrugated carton of claim 5, wherein each of the end walls is interconnected between the top panel and the bottom panel, and each of the end walls extends laterally between opposite distal edges.

7. The corrugated carton of claim 1, wherein the bottom panel includes first and second flaps which extend from respective side walls and toward one another, and the flaps terminate in upwardly extending sections which are disposed adjacent one another and underlie a central portion of the top panel, thereby increasing end to end strength of the carton.

8. The corrugated carton of claim 7, wherein the openings through the top panel are arranged in a two-dimensional array, and one-half of the openings are disposed to one side of the central portion, and one-half of the openings are disposed to an opposite side of the central portion.

9. The corrugated carton of claim 1, wherein the bottom panel includes first and second flaps which extend from respective side walls and toward one another, and each of the flaps has opposite end sections which are disposed inside the end walls and secured to respective end walls.

10. The corrugated carton of claim 1, wherein the sheet of corrugated is corrugated in such a manner that reinforcing ribs extend vertically on the side walls, perpendicular to the top panel and the bottom panel, and reinforcing ribs extend horizontally on the end walls, parallel to the top panel and the bottom panel.

11. A corrugated carton in combination with at least four cans, comprising at least one corrugated sheet having a top panel, a bottom panel, first and second side walls and first and second end walls, wherein fold lines are defined between the top panel and the first and second side walls and between the top panel and the first and second end walls, and intermittently spaced slits extend through the sheet along the fold lines, and discrete openings extend through the top panel, and the cans are nested within respective openings with respective can sidewalls extending through the openings and respective can rims overlying discrete portions of the top panel.

12. The corrugated carton and at least four cans of claim 11, wherein each of the openings has a width and a relatively longer length, and the corrugated sheet has reinforcing ribs which extend perpendicular to each said length and parallel to each said width.

13. The corrugated carton and at least four cans of claim 11, wherein the openings are arranged in a two-dimensional array.

14. The corrugated carton and at least four cans of claim 13, wherein at least one intermediate panel is secured between the top panel and the bottom panel and divides the array into two equal halves.

15. The corrugated carton and at least four cans of claim 11, wherein the side walls and the end walls define a carton depth, and adjacent distal edges of the side walls and the end walls are separated by gaps which extend the depth of the carton.

16. A corrugated carton sized and configured to retain a plurality of otherwise loose cans, comprising:

at least one sheet of corrugated formed into a parallelepiped configuration having a top panel, a bottom panel, opposite end walls, having lateral edges and opposite side walls having lateral edges, wherein openings extend through the top panel to receive the cans, and intermittently spaced slits extend through the corrugated at otherwise integral junctures defined between the top panel and respective side walls to facilitate flexing of the carton in response to impact directed against the side walls and the lateral edges of the end walls are free from the lateral edges of the side walls to permit flexing along the slits in response to impact directed against the side walls, wherein the bottom panel includes first and second flaps which extend from respective side walls and toward one another, and each of the flaps has opposite end sections which are disposed inside the end walls and secured to respective end walls.

* * * * *